US011346555B2

(12) United States Patent
Freeman et al.

(10) Patent No.: US 11,346,555 B2
(45) Date of Patent: May 31, 2022

(54) COMBUSTOR FOR A GAS TURBINE ENGINE WITH CERAMIC MATRIX COMPOSITE HEAT SHIELD

(71) Applicants: Rolls-Royce Corporation, Indianapolis, IN (US); Rolls-Royce North American Technologies Inc., Indianapolis, IN (US)

(72) Inventors: Ted J. Freeman, Danville, IN (US); Aaron D. Sippel, Zionsville, IN (US); Paulo Bazan, Coconut Creek, FL (US)

(73) Assignees: Rolls-Royce Corporation, Indianapolis, IN (US); Rolls-Royce North American Technologies Inc., Indianapolis, IN (US)

( * ) Notice: Subject to any disclaimer, the term of this patent is extended or adjusted under 35 U.S.C. 154(b) by 245 days.

(21) Appl. No.: 16/596,268

(22) Filed: Oct. 8, 2019

(65) Prior Publication Data

US 2021/0102702 A1 Apr. 8, 2021

(51) Int. Cl.
*F23R 3/00* (2006.01)
*F23R 3/60* (2006.01)

(52) U.S. Cl.
CPC ..... *F23R 3/007* (2013.01); *F23R 3/002* (2013.01); *F23R 3/60* (2013.01); *F05D 2240/35* (2013.01); *F23R 2900/00017* (2013.01)

(58) Field of Classification Search
CPC ..... F23R 3/007; F23R 3/60; F23R 3/002
See application file for complete search history.

(56) References Cited

U.S. PATENT DOCUMENTS

| | | | | |
|---|---|---|---|---|
| 4,975,014 | A | 12/1990 | Rufin et al. | |
| 5,090,857 | A * | 2/1992 | Dunn | F16B 35/02 411/908 |
| 5,363,643 | A | 11/1994 | Halila | |
| 5,577,379 | A | 11/1996 | Johnson | |
| 5,634,754 | A | 6/1997 | Weddendorf | |
| 6,412,272 | B1 | 7/2002 | Titterton, III et al. | |
| 6,907,920 | B2 | 6/2005 | Warburton et al. | |
| 7,153,054 | B2 | 12/2006 | Arbona | |
| 7,845,174 | B2 | 12/2010 | Parkman et al. | |
| 7,966,832 | B1 | 6/2011 | Lockyer et al. | |
| 9,598,981 | B2 | 3/2017 | Salunkhe et al. | |
| 9,964,309 | B2 | 5/2018 | Corsmeier et al. | |
| 2007/0031258 | A1 | 2/2007 | Campbell | |
| 2008/0229750 | A1 | 9/2008 | Sipson | |
| 2010/0189529 | A1 | 7/2010 | Steffier | |
| 2015/0260404 | A1* | 9/2015 | Sullivan | F23R 3/48 60/754 |
| 2016/0161121 | A1 | 6/2016 | Chang | |
| 2016/0186997 | A1* | 6/2016 | Sadil | F02C 7/16 411/347 |
| 2016/0186999 | A1 | 6/2016 | Freeman et al. | |
| 2018/0094811 | A1 | 4/2018 | Radwanski et al. | |
| 2018/0094812 | A1 | 4/2018 | Corsmeier | |

(Continued)

*Primary Examiner* — Katheryn A Malatek
(74) *Attorney, Agent, or Firm* — Barnes & Thornburg LLP

(57) ABSTRACT

A combustor adapted for use in a gas turbine engine a combustor shell, a heat shield, and a heat shield retainer. The combustor shell is made from metallic materials and is formed to define an internal cavity. The heat shield is formed from ceramic matrix composite materials and is coupled to the dome panel. The heat shield retainer is configured to retain the heat shield to the combustor shell.

19 Claims, 6 Drawing Sheets

(56) References Cited

U.S. PATENT DOCUMENTS

| | | | |
|---|---|---|---|
| 2018/0363505 | A1 | 12/2018 | Dziech |
| 2019/0003710 | A1 | 1/2019 | Corsmeier |
| 2019/0078785 | A1* | 3/2019 | Propheter-Hinckley ..... F23R 3/54 |

* cited by examiner

COMBUSTOR FOR A GAS TURBINE ENGINE WITH CERAMIC MATRIX COMPOSITE HEAT SHIELD

FIELD OF THE DISCLOSURE

The present disclosure relates generally to combustors used in gas turbine engines, and more specifically to a combustor including a metallic case and a heat shield.

BACKGROUND

Engines, and particularly gas turbine engines, are used to power aircraft, watercraft, power generators and the like. Gas turbine engines typically include a compressor, a combustor, and a turbine. The compressor compresses air drawn into the engine and delivers high pressure air to the combustor. The combustor is a component or area of a gas turbine engine where combustion takes place. In a gas turbine engine, the combustor receives high pressure air and adds fuel to the air which is burned to produce hot, high-pressure gas. After burning the fuel, the hot, high-pressure gas is passed from the combustor to the turbine. The turbine extracts work from the hot, high-pressure gas to drive the compressor and residual energy is used for propulsion or sometimes to drive an output shaft.

Combustors include heat shields that contain the burning fuel during operation of a gas turbine engine. The heat shield included in the combustor is designed and built to withstand high-temperatures induced during combustion. In some cases, heat shields may be made from metallic superalloys. In other cases, heat shields may be made from ceramic matrix composites (CMCs) which are a subgroup of composite materials as well as a subgroup of technical ceramics. CMCs may comprise ceramic fibers embedded in a ceramic matrix. The matrix and fibers can consist of any ceramic material, in which carbon and carbon fibers can also be considered a ceramic material.

Combustors and turbines made of metal alloys often require significant cooling to be maintained at or below their maximum use temperatures. The operational efficiencies of gas turbine engines are sometimes increased with the use of CMC materials that require less cooling and have operating temperatures that exceed the maximum use temperatures of most metal alloys. The reduced cooling required by CMC combustor heat shields when compared to metal alloy combustion heat shields can permit greater temperature uniformity and can lead to reduced undesirable emissions.

One challenge relating to the use of CMC heat shields is that they are sometimes secured to the surrounding metal shell via metal fasteners. Metal fasteners can lose their strength and may even melt at CMC operating temperatures. Since the allowable operating temperature of a metal fastener is typically lower than the allowable operating temperature of the CMC, metal fasteners, and/or the area surrounding it, is often cooled to allow it to maintain its strength. Such configurations may undermine the desired high temperature capability of the CMC. Accordingly, new techniques and configurations are needed for coupling components, such as CMC, to the walls of enclosures experiencing high-temperature environments.

SUMMARY

The present disclosure may comprise one or more of the following features and combinations thereof.

According to a first aspect of the present disclosure, a combustor for use in a gas turbine engine includes a combustor shell, a heat shield, and a plurality of heat shield retainers. The combustor shell includes metallic materials adapted to be mounted in the gas turbine engine and is formed to define an internal cavity. The combustor shell includes an outer annular wall that extends circumferentially around a central reference axis. The combustor shell may further include an inner annular wall arranged radially inward from the outer annular wall to provide the internal cavity between the outer annular wall and the inner annular wall. The combustor shell may further include a dome panel that extends from an axially-forward end of the outer annular wall to the inner annular wall to form a forward wall. The dome panel may be shaped to include fuel nozzle apertures spaced circumferentially around the central reference axis that open into the internal cavity.

In some embodiments, the heat shield includes ceramic matrix composite materials. The heat shield may be coupled to the dome panel and arranged within the internal cavity to shield the dome panel from temperatures developed by burning fuel within a combustion chamber inside the internal cavity during use of the combustor in the gas turbine engine.

In some embodiments, the heat shield includes a shield panel, a first mount flange arranged along a first circumferential side of the shield panel, and a second mount flange arranged along a second circumferential side of the shield panel. The plurality of heat shield retainers are configured to retain the heat shield to the dome panel.

In some embodiments, the first and second mount flanges each include at least one attachment post that extends axially through an attachment aperture formed in the dome panel to engage a corresponding heat shield retainer arranged on an axially-forward side of the dome panel. The attachment aperture may be sized and shaped so that the dome panel moves relative to the heat shield due to different rates of thermal expansion without forming stresses in the heat shield as a result of binding between the heat shield and the combustor shell.

In some embodiments, the first mount flange includes an offset lip that extends along the first circumferential side from a radially outer edge of the shield panel to a radially inner edge of the shield panel and a first attachment post located about midway between the radially outer edge and the radially inner edge.

In some embodiments, the second mount flange includes an offset lip that extends along the second circumferential side from the radially outer edge of the shield panel to the radially inner edge of the shield panel and a first attachment post located closer to the radially outer edge than the radially inner edge and a second attachment post located closer to the radially inner edge than the radially outer edge. In some embodiments, the heat shield is bent at each circumferential side to provide the first mount flange and the second mount flange.

In some embodiments, the first attachment post of the first mount flange is positioned radially between attachment posts of a circumferentially neighboring heat shield. In some embodiments, the first attachment post of the second mount flange is positioned radially above an attachment post of a circumferentially neighboring heat shield and the second attachment post of the second mount flange is positioned radially below the attachment post of the circumferentially neighboring heat shield.

In some embodiments, the dome panel of the combustor shell is formed to include a plurality of attachment apertures including a first circular-shaped attachment aperture, a second elongated attachment aperture spaced apart circumferentially from the first attachment aperture, and a third elongated attachment aperture spaced apart circumferentially from the first attachment aperture and radially from the second attachment aperture.

In some embodiments, the second attachment aperture is elongated along a first axis and the third attachment aperture is elongated along a second axis and the first and second axes intersect at the first attachment aperture.

In some embodiments, the plurality of attachment apertures further comprises a fourth elongated attachment aperture spaced apart radially from the first attachment aperture and circumferentially from the second and third attachment apertures and the fourth attachment aperture is elongated along a third axis that intersects with the first and second axes at the first attachment aperture.

In some embodiments, each heat shield retainer includes a first half and a second half arranged to combine with the first half and enclose a respective attachment post to block the attachment post from being removed from the attachment aperture. In some embodiments, the attachment post has a shape and the first half and the second half are formed to include a groove that matches the shape of the attachment post, each groove having a depth that is about half of a thickness of the attachment post. In some embodiments, the first half and the second half are retained together by a spring clip to block the attachment post from being removed from the attachment aperture.

In some embodiments, the first mount flange includes an offset lip that extends from a radially outer edge of the shield panel to a radially inner edge of the shield panel, a first attachment post located closer to the radially outer edge than the radially inner edge, and a second attachment post located closer to the radially inner edge than the radially outer edge.

In some embodiments, the second mount flange includes an offset lip that extends from the radially outer edge of the shield panel to the radially inner edge of the shield panel, a first attachment post located closer to the radially outer edge than the radially inner edge, and a second attachment post located closer to the radially inner edge than the radially outer edge.

In some embodiments, the first attachment post of the first mount flange is aligned radially with the first attachment post of the second mount flange and the second attachment post of the first mount flange is aligned radially with the second attachment post of the second mount flange.

In some embodiments, the heat shield is formed from a ceramic ply layup comprising a back-plate ply forming an axially aft surface of the shield panel, a front-plate ply forming a portion of an axially forward surface of the shield panel and a portion of the first and second mount flanges, a first edge ply forming a portion of the axially forward surface of the shield panel and a portion of the first mount flange, and a second edge ply forming a portion of the axially forward surface of the shield panel and a portion of the second mount flange.

According to another aspect of the present disclosure, a method of retaining a heat shield to a combustor in a gas turbine engine includes providing the combustor. The combustor may include at least one panel made from metallic materials.

In some embodiments, the method further includes forming the heat shield from ceramic matrix composite components. The heat shield includes a shield panel lining the panel of the combustor and providing a boundary for an interior combustion chamber.

In some embodiments, The heat shield further includes a first mount flange arranged along a first circumferential side of the shield panel and a second mount flange arranged along a second circumferential side of the shield panel. The first and second mount flange may each include at least one attachment post that extends away from the shield panel.

In some embodiments, the method may further include forming a plurality of attachment apertures in the panel of the combustor. In some embodiments, the method may further include inserting the attachment posts through respective attachment apertures. In some embodiments, the method may further include retaining each attachment post to the panel to block removal of the attachment posts from the attachment apertures.

In some embodiments, the attachment apertures are sized and shaped so that the panel is allowed to move relative to the heat shield due to different rates of thermal expansion without forming stresses in the heat shield as a result of binding between the heat shield and the panel.

In some embodiments, the step of retaining each attachment post includes providing a heat shield retainer for each attachment post. In some embodiments, the heat shield retainer includes a first half, a second half arranged to combine with the first half and enclose a respective attachment post to block the attachment post from being removed from the attachment aperture, and a spring clip configured to retain the first half to the second half enclosing the attachment post.

In some embodiments, the step of forming the heat shield includes forming the heat shield from at least one ceramic ply that is bent at each circumferential edge to provide the first mount flange and the second mount flange once infiltrated with ceramic matrix material so that the first mount flange and the second mount flange are made integral with the shield panel.

In some embodiments, the step of forming the heat shield includes forming the heat shield from a ceramic ply layup comprising a back-plate ply forming an axially aft surface of the shield panel, a front-plate ply forming a portion of an axially forward surface of the shield panel and a portion of the first and second mount flanges, a first edge ply forming a portion of the axially forward surface of the shield panel and a portion of the first mount flange, and a second edge ply forming a portion of the axially forward surface of the shield panel and a portion of the second mount flange.

These and other features of the present disclosure will become more apparent from the following description of the illustrative embodiments.

DETAILED DESCRIPTION

Figure 1:
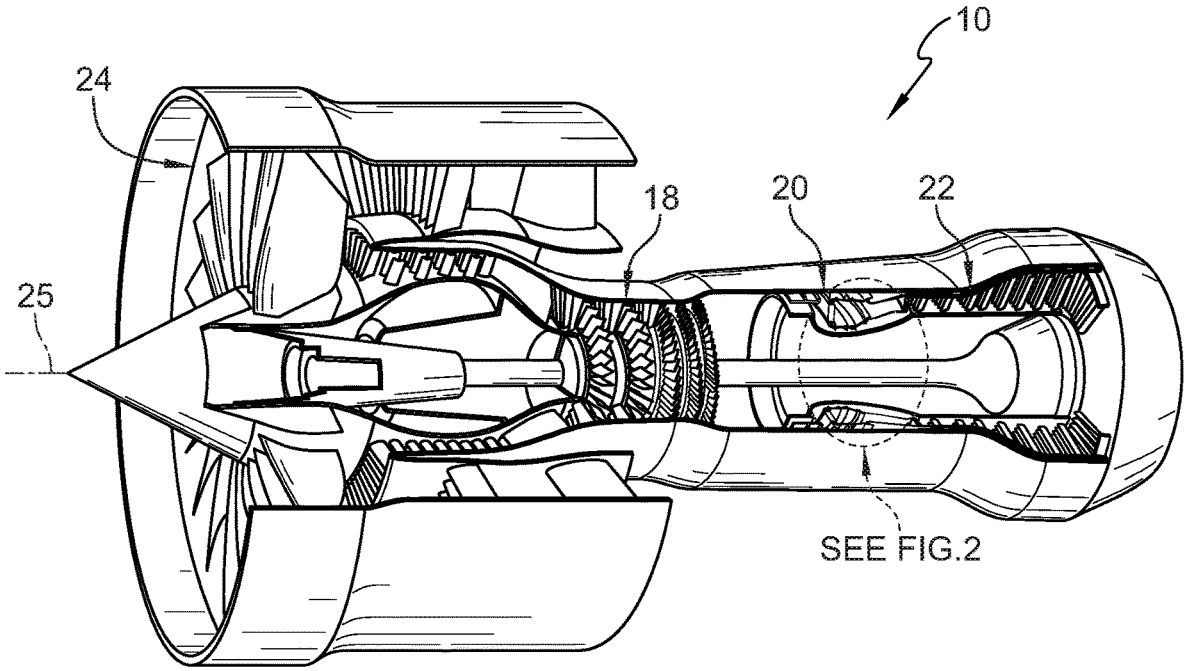
FIG. 1 is a partial perspective view of a gas turbine engine, in accordance with the present disclosure, showing that the gas turbine engine includes a compressor, a combustor, a turbine, and a fan that is driven in rotation about a central reference axis by the turbine upon combustion of fuel and pressurized air in the combustor.

For the purposes of promoting an understanding of the principles of the disclosure, reference will now be made to a number of illustrative embodiments illustrated in the drawings and specific language will be used to describe the same.

A gas turbine engine 10, in accordance with the present disclosure, is shown in FIG. 1. The gas turbine engine 10 includes a compressor 18, a combustor 20, and a turbine 22. The compressor 18 is configured to pressurize air and delivers the pressurized air to the combustor 20 during operation. Fuel is injected in to the combustor 20 and ignited with the pressurized air to produce hot, high pressure gases which are discharged from the combustor 20 toward the turbine 22. The hot, high pressure gases drive rotation of rotating components (i.e. blades and disks) in the turbine 22 about a central reference axis 25 which drives rotation of a fan 24 to provide thrust for the gas turbine engine 10.

Figure 2:
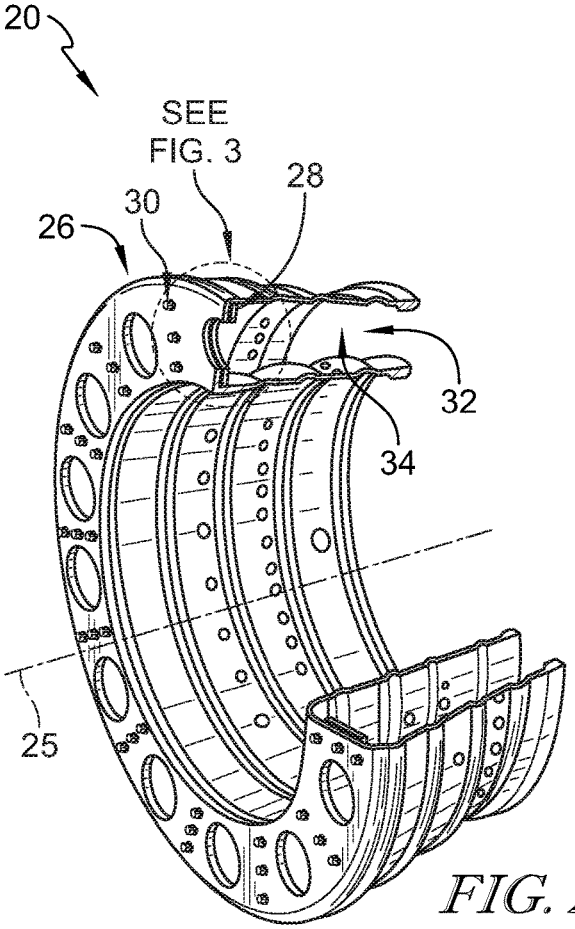
FIG. 2 is an enlarged perspective view of the combustor from FIG. 1 with portions cut away showing that the combustor includes (i) a combustor shell made from metallic materials and defining an internal cavity, (ii) a heat shield arranged along an axially forward end of the combustor shell, and (iii) a plurality of heat shield retainers configured to mount the heat shield to the combustor shell and block removal of the heat shield.
Figure 3:
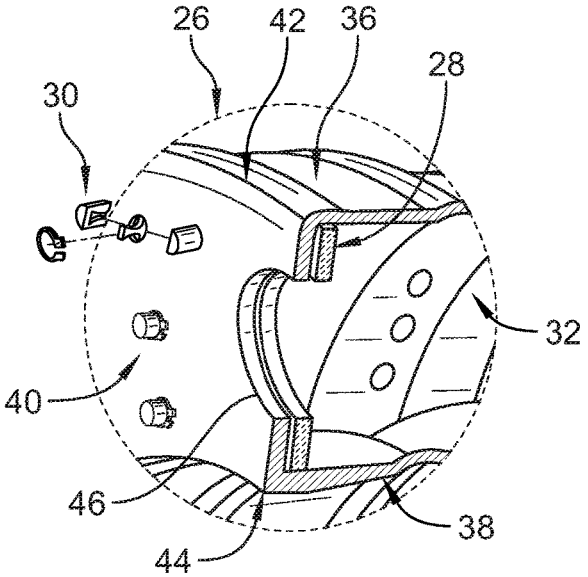
FIG. 3 is an enlarged perspective view of a portion of the combustor from FIG. 2 with one of the heat shield retainers exploded away from the combustor shell showing that the heat shield includes an integral attachment post and the heat shield retainer is formed to include a groove with a shape that matches the attachment post to receive and retain the attachment post when the heat shield retainer is assembled.

The combustor 20 operates at extremely high temperatures during operation of the gas turbine engine 10. The combustor 20 includes a combustor shell 26 made from metallic materials, a plurality of heat shields 28 made from ceramic matrix composite materials, and a plurality of heat shield retainers 30 as shown in FIGS. 2 and 3. The combustor shell 26 is mounted within the gas turbine engine 10 upstream of the turbine 22 and is formed to define an internal cavity 32. The plurality of heat shields 28 are coupled to the combustor shell 26 and are configured to block hot gases from coming into contact with portions of the combustor shell 26. The plurality of heat shield retainers 30 are configured to engage a portion of respective heat shields 28 and retain the plurality of heat shields 28 to the combustor shell 26.

The plurality of heat shields 28 each extend partway around the central reference axis 25 and cooperate to provide a boundary of a combustion chamber 34 within the internal cavity 32. Combustion of fuel and gases occurs in the combustion chamber 34 and produces hot gases which, absent the plurality of heat shields 28, may damage portions of the combustor shell 26. The ceramic matrix composite materials forming the plurality of heat shields 28 are able to withstand much higher temperatures as compared to the metallic materials forming the combustor shell 26. As such, the plurality of heat shields 28 are arranged along inner surfaces of the combustor shell 26 defining the internal cavity 32 to define at least a portion of the combustion chamber 34 and block the hot gases from reaching the combustor shell 26.

The combustor shell 26 includes an outer wall 36, an inner wall 38 spaced apart from the outer wall 36, and a dome panel 40 as shown in FIGS. 2 and 3. The outer wall 36 is annular and extends circumferentially around the central reference axis 25. The inner wall 38 is annular and arranged radially inward from the outer wall 36 to provide the internal cavity 32 between the outer wall 36 and the inner wall 38. The dome panel 40 is coupled to an axially-forward end 42, 44 of the outer wall 36 and the inner wall 38.

The dome panel 40 is formed to include a plurality of fuel nozzle apertures 46 that open into the internal cavity 32. Fuel nozzles (not shown) extend through the fuel nozzle apertures 46 and into or adjacent to the combustion chamber 34 and are configured to spray and ignite fuel flowing therethrough. The hot gases produced by the combustion reaction flow aft through the combustion chamber 34 until they exit the combustion chamber 34 toward the turbine 22 where the hot gases are used to drive rotation of components in the turbine 22.

Although the combustor includes a plurality of heat shields 28 in the illustrative embodiment, each of the heat shields 28 are substantially similar. Accordingly, only one heat shield 28 is described below. In the illustrative embodiment, the heat shield 28 is coupled to an axially-aft surface of the dome panel 40 and is arranged within the internal cavity 32 as shown in FIG. 3. However, in other embodiments, the heat shield 28 may be in the form of a combustor tile mounted to an inner surface of the outer wall 36 or the inner wall 38 in the interior space 32. The heat shield 28 is configured to shield the dome panel 40 from temperatures developed by burning fuel within the combustion chamber 34 inside the internal cavity 32.

Figure 4:
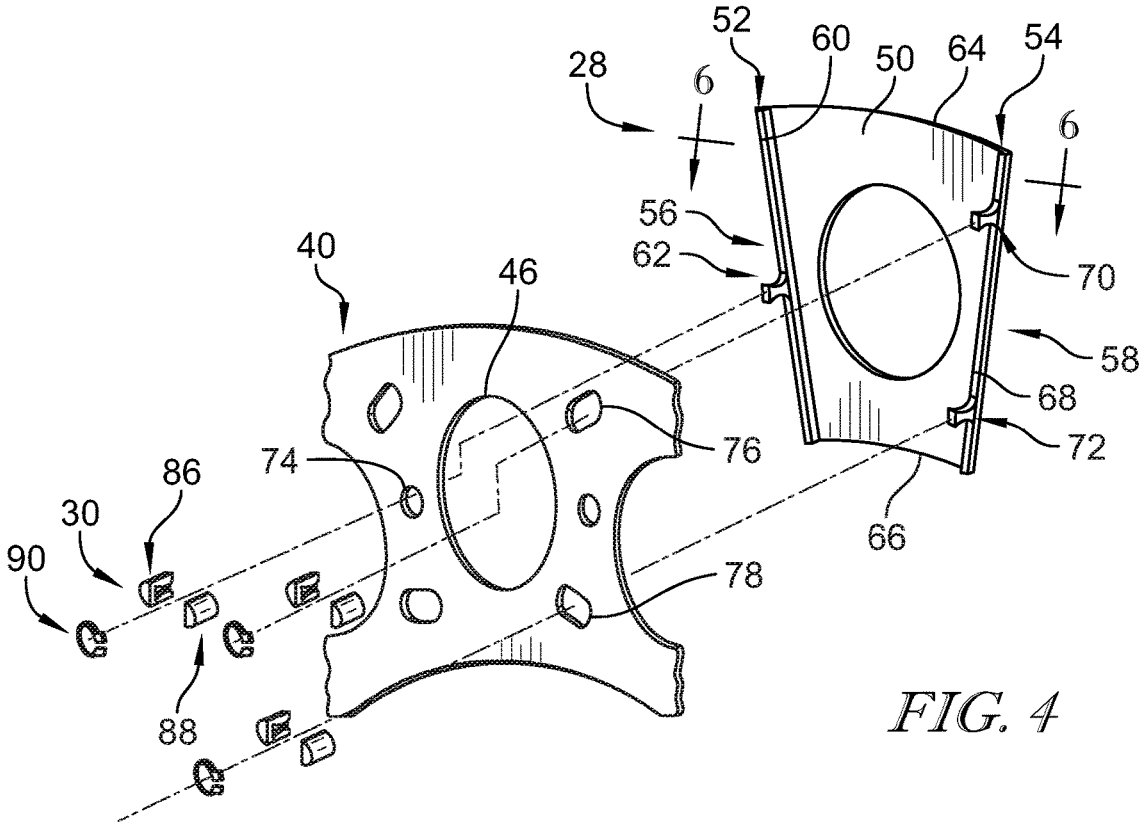
FIG. 4 is an exploded assembly view of a portion of the combustor from FIGS. 1-3 showing that the combustor shell is formed to include a plurality of attachment apertures that correspond to a plurality of attachment posts coupled to the heat shield and are sized and shaped to allow movement of the combustor shell relative to the heat shield as a result of different rates of thermal expansion.

The heat shield 28 is formed into a one-piece CMC and includes a shield panel 50, a first mount flange 52, and a second mount flange 54 as shown in FIG. 4. The shield panel 50 borders an inner surface of the combustor shell 26 to protect the combustor shell from the burning gases in the combustion chamber 34. The first mount flange 52 is arranged along a first circumferential side 56 of the shield panel 50. The second mount flange 54 is arranged along a second circumferential side 58 of the shield panel 50 opposite the first circumferential side 56.

Figure 6:
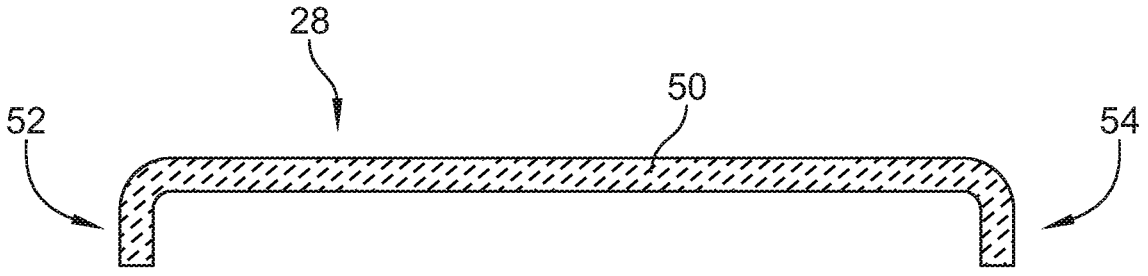
FIG. 6 is a cross section view of the heat shield taken along line 6-6 in FIG. 4 showing that the heat shield is formed from a single ceramic matrix composite ply that is molded to provide a heat shield that includes a shield panel, a first mount flange arranged along a first circumferential side of the shield panel, and a second mount flange arranged along a second circumferential side of the shield panel.

The heat shield 28 is formed from a single ceramic ply that is shaped to provide the first mount flange 52 and the second mount flange 54. The first and second mount flanges 52, 54 extend away from the shield panel 50 toward the dome panel 40 of the combustor shell 26 as shown in FIGS. 4 and 6. The first mount flange 52 includes an offset lip 60 and a first attachment post 62 coupled to the offset lip 60. The first offset lip 60 extends along the first circumferential side 56 from a radially outer edge 64 of the shield panel 50 to a radially inner edge 66 of the shield panel 50. The first attachment post 62 is located about midway between the radially outer edge 64 and the radially inner edge 66 in the illustrative embodiment.

The second mount flange 54 includes an offset lip 68, and a pair of attachment posts 70, 72 coupled to the offset lip 68 as shown in FIG. 4. The offset lip 68 extends along the second circumferential side 58 from the radially outer edge 64 of the shield panel 50 to the radially inner edge 66 of the shield panel 50. The first attachment post 70 is located closer to the radially outer edge 64 than the radially inner edge 66. The second attachment post 72 is located closer to the radially inner edge 66 than the radially outer edge 64. The first attachment post 62 of the first mount flange 52 is spaced circumferentially from the second mount flange 54 and located radially between the first and second attachment posts 70, 72 of the second mount flange 54.

Figure 5:
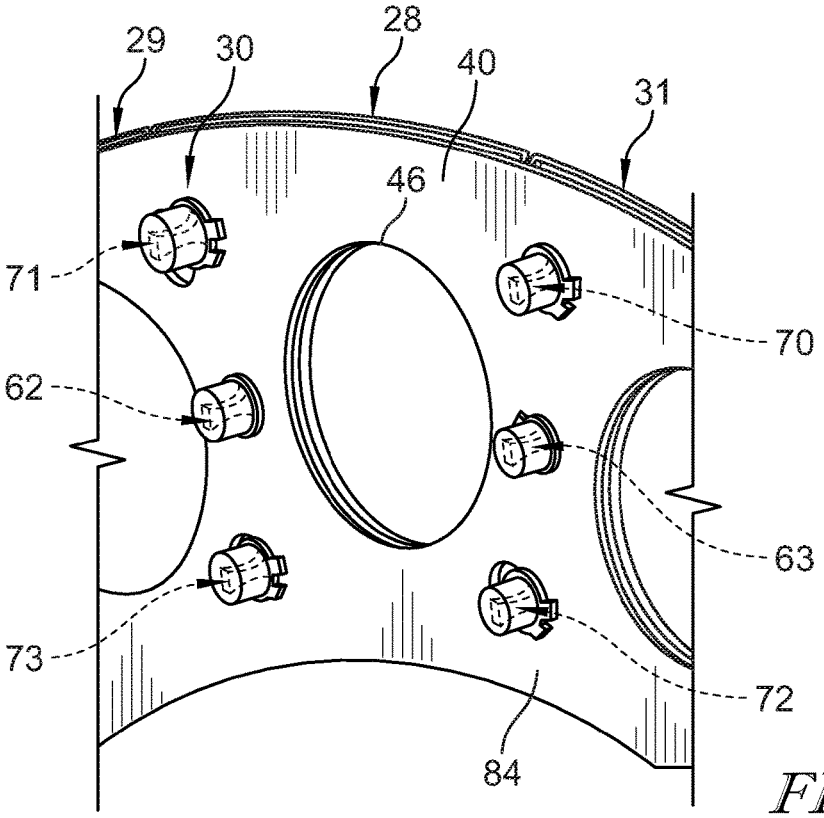
FIG. 5 is an assembled view of the portion of the combustor from FIG. 4 with each of the attachment posts drawn in phantom to indicate that they are received and retained by respective heat shield retainers to block removal of the heat shield.

Each of the attachment posts 62, 70, 72 extends axially through a corresponding attachment aperture 74, 76, 78 formed in the dome panel 40 to mount the heat shield 28 to the dome panel 40 as shown in FIGS. 4 and 5. The attachment apertures 74, 76, 78 are sized and shaped so that the dome panel 40 can move relative to the heat shield 28 due to different rates of thermal expansion between the dome panel 40 and the heat shield 28. This blocks binding stresses from forming in the heat shield 28 as a result of the different expansion rates which could damage the heat shield 28 and leave the combustor shell vulnerable to the hot gases. The plurality of attachment apertures includes a first circular-shaped attachment aperture 74, a second elongated attachment aperture 76, and a third elongated attachment aperture 78. The first attachment aperture 74 is located on an opposite circumferential side of the fuel nozzle aperture 46 from the second and third attachment apertures 76, 78. The second and third attachment apertures 76, 78 are generally aligned circumferentially and are spaced apart radially from one another.

Figure 7:
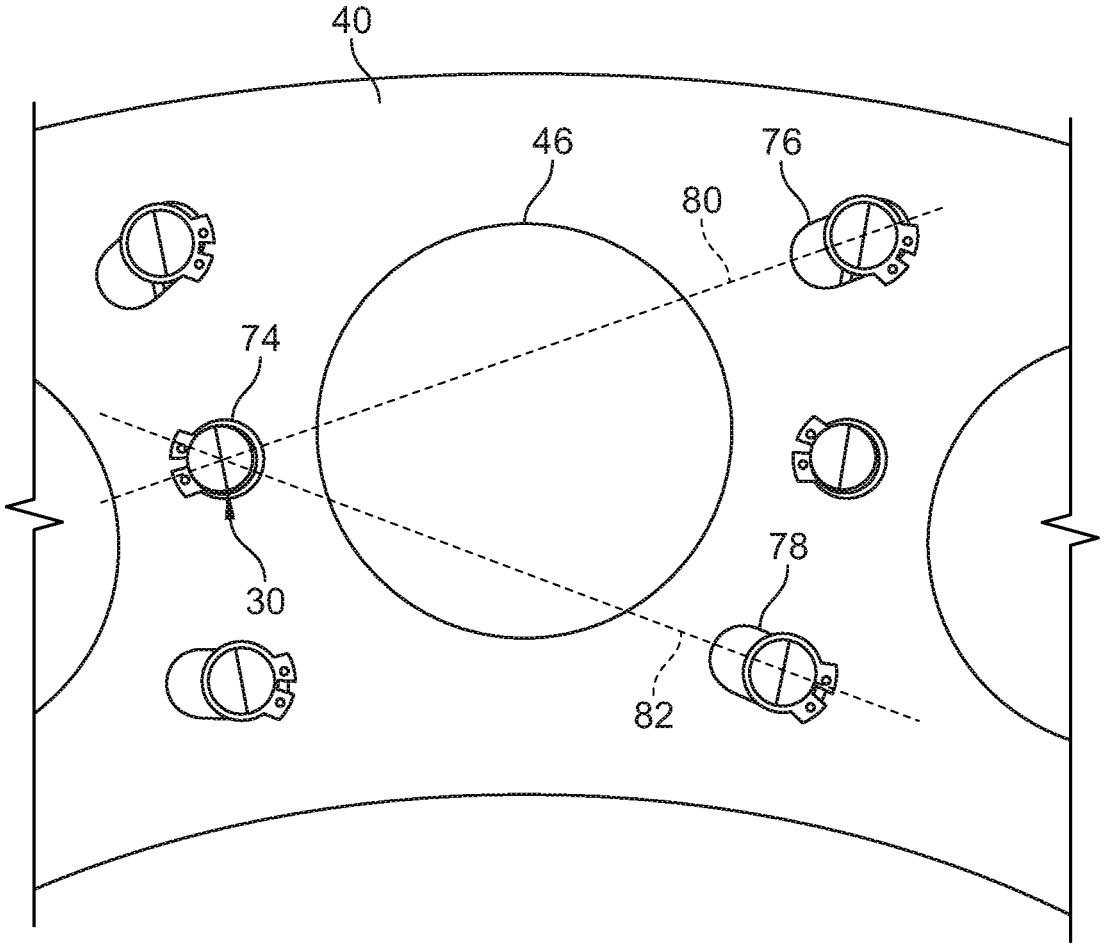
FIG. 7 is an aft-looking elevation view of the portion of the combustor shown in FIG. 5 with dashed lines indicating that two of the attachment apertures are elongated along respective axes that intersect at a third circular-shaped attachment aperture.

The attachment apertures 74, 76, 78 cooperate to locate the heat shield 28 relative to the first attachment aperture 74 while allowing movement of the second and third attachment apertures 76, 78 relative to the heat shield 28 as the dome panel 40 expands. The first attachment post 62 is received in the first attachment aperture 74 and is generally fixed relative to the dome panel 40 as shown in FIG. 7. The second attachment post 70 is received in the second attachment aperture 76 while the third attachment post 72 is received in the third attachment aperture 78. The second attachment aperture 76 is elongated along a first axis 80. The third attachment aperture 78 is elongated along a second axis 82. The first and second axes 80, 82 intersect at the first attachment aperture 74. The dome panel 40 moves relative to the second and third attachment posts 70, 72 such that the attachment posts 70, 72 slide along axes 80, 82 through the attachment apertures 76, 78 as the dome panel 40 expands and contracts.

In the illustrative embodiment, the heat shield 28 cooperates with neighboring heat shields 29, 31 to line the combustor shell 26. The first attachment post 62 of the first mount flange 52 is positioned radially between attachment posts 71, 73 of circumferentially neighboring heat shield 29. The first attachment post 70 of the second mount flange 54 is located radially above an attachment post 63 of circumferentially neighboring heat shield 31. The second attachment post 72 of the second mount flange 54 is located radially below the attachment post 63 of circumferentially neighboring heat shield 31. This same arrangement is provided for all of the heat shields 28 of the combustor 20 circumferentially around the central reference axis 25.

Once the attachment posts 62, 70, 72 are positioned in their respective attachment apertures 74, 76, 78, a corresponding heat shield retainer 30 is configured to engage each attachment post 62, 70, 72 along an outer surface 84 of the dome panel 40 as shown in FIGS. 5 and 7. The heat shield retainers 30 have a diameter that is larger than the attachment apertures 74, 76, 78 to block the attachment posts 62, 70, 72 from being removed from the attachment apertures 74, 76, 78.

Each heat shield retainer 30 includes a first half 86, a second half 88, and a clip 90 as shown in FIGS. 4 and 8-10. Some of the heat shield retainers 30 are shown slightly offset from their respective aperture in FIG. 4 so that the first half 86, the second half 88, and the clip 90 of each heat shield retainer 30 is visible in FIG. 4. The first half 86 is arranged to combine with the second half 88 to enclose each respective attachment post 62, 70, 72 to block each attachment post 62, 70, 72 from being removed from its attachment aperture 74, 76, 78. The clip 90 is fitted around the first and second halves 86, 88 to retain the first and second halves 86, 88 together around an attachment post as shown in FIG. 5.

Figure 8:
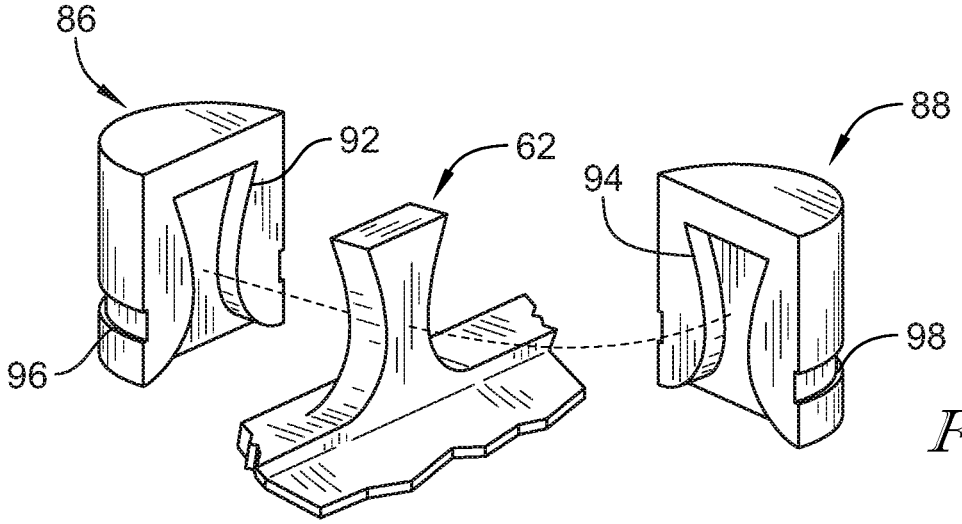
FIG. 8 is an exploded perspective view of one of the attachment posts with a dovetail shape and a portion of one of the heat shield retainers showing that the heat shield retainer includes a first half with a groove that matches the shape of the attachment post and a second half with a groove that matches the shape of the attachment post.

Attachment post 62 is shown in detail in FIG. 8 with respective first and second halves 86, 88 disassembled. Attachment post 62 is substantially similar to attachment posts 70, 72. Additionally, the first and second halves 86, 88 of each heat shield retainer 30 are substantially similar. Accordingly, only one attachment post 62 and a corresponding heat shield retainer 30 is shown in FIG. 8. The attachment post 62 has a dovetail shape. The first and second halves 86, 88 are formed to include grooves 92, 94 that match the shape of the attachment post 62. The grooves 92, 94 have a depth that is at least half of a thickness of the attachment post 62. When assembled, the halves 86, 88 lock the attachment post 62 in the grooves 92, 94 and block the attachment post from being removed from a corresponding aperture formed in the dome panel 40. Each half 86, 88 of the heat shield retainer 30 is also formed to include a slot 96, 98 that is sized to receive the clip 90, as shown in FIGS. 4 and 5. The slots 86, 88 block movement of the clip 90 relative to the halves 86, 88.

Figure 9:
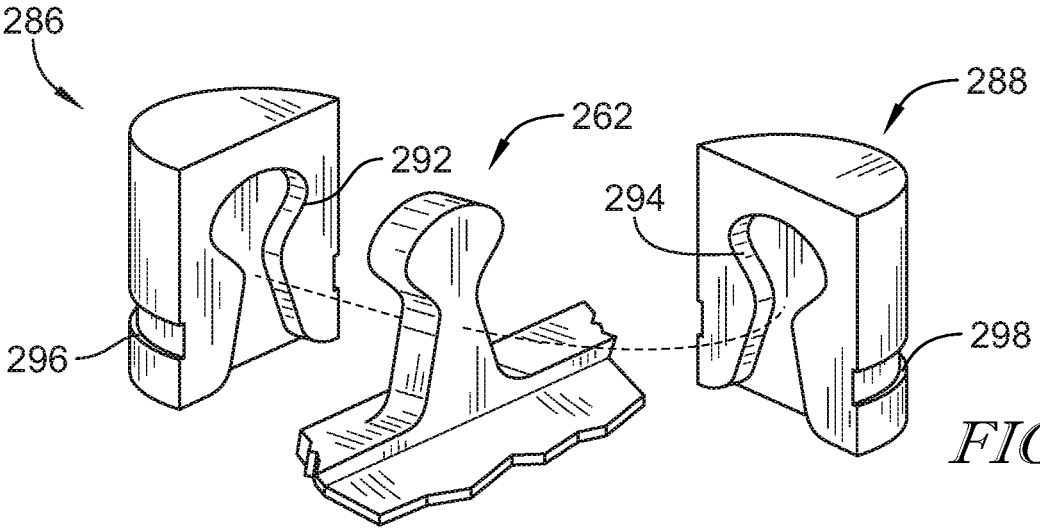
FIG. 9 is an exploded perspective view of another embodiment of an attachment post with a bulb shape and a portion of another embodiment of a heat shield retainer showing that the heat shield retainer includes a first half with a groove that matches the shape of the attachment post and a second half with a groove that matches the shape of the attachment post.

Another embodiment of an attachment post 262 is shown in detail in FIG. 9 with respective first and second halves 286, 288 of another heat shield retainer disassembled. Although only one attachment post 262 and heat shield retainer is shown in FIG. 9, other attachment posts formed on the heat shield may also have the features described below. The attachment post 262 has a bulb shape. The first and second halves 286, 288 of the heat shield retainer are formed to include grooves 292, 294 that match the shape of the attachment post 262. The grooves 292, 294 have a depth that is at least half of a thickness of the attachment post 262. When assembled, the halves 286, 288 lock the attachment post 262 in the grooves 292, 294 and block the attachment post 262 from being removed from a corresponding aperture formed in the dome panel 40. Each half 286, 288 of the heat shield retainer is also formed to include a slot 296, 298 that is sized to receive a clip 90 to retain the halves 286, 288 together. The slots 286, 288 block movement of the clip 90 relative to the halves 286, 288.

Figure 10:
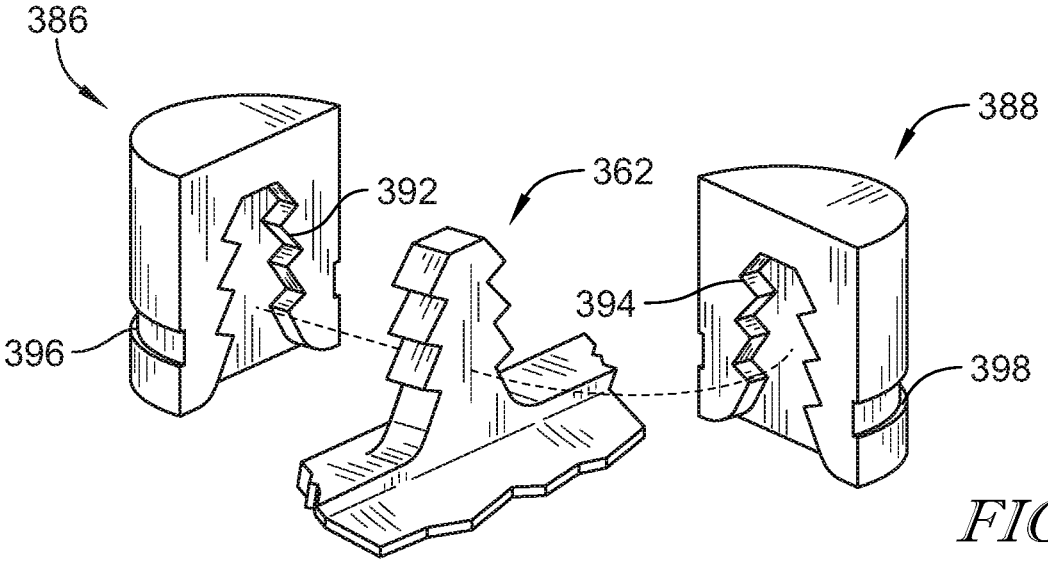
FIG. 10 is an exploded perspective view of another embodiment of an attachment post with a firtree shape and a portion of another embodiment of a heat shield retainer showing that the heat shield retainer includes a first half with a groove that matches the shape of the attachment post and a second half with a groove that matches the shape of the attachment post.

Another embodiment of an attachment post 362 is shown in detail in FIG. 10 with respective first and second halves 386, 388 of a heat shield retainer disassembled. Although only one attachment post 362 and heat shield retainer is shown in FIG. 10, other attachment posts formed on the heat shield may also have the features described below. The attachment post 362 has a firtree shape. The first and second halves 386, 388 are formed to include grooves 392, 394 that match the shape of the attachment post 362. The grooves 392, 394 have a depth that is at least half of a thickness of the attachment post 362. When assembled, the halves 386, 388 lock the attachment post 362 in the grooves 392, 394 and block the attachment post from being removed from a corresponding aperture formed in the dome panel 40. Each half 386, 388 of the heat shield retainer is also formed to include a slot 396, 398 that is sized to receive a clip 90 to retain the halves 386, 388 together. The slots 386, 388 block movement of the clip 90 relative to the halves 386, 388.

Another embodiment of a combustor 420 for use in the gas turbine engine 10 is shown in FIGS. 11-14. The combustor 420 is substantially similar to combustor 20 shown in FIGS. 1-10 and described above. Similar features common between combustor 20 and combustor 420 are indicated by similar reference numbers in the 400 series. The disclosure of combustor 20 is incorporated by reference herein for combustor 420 and differences are described below.

Figure 11:
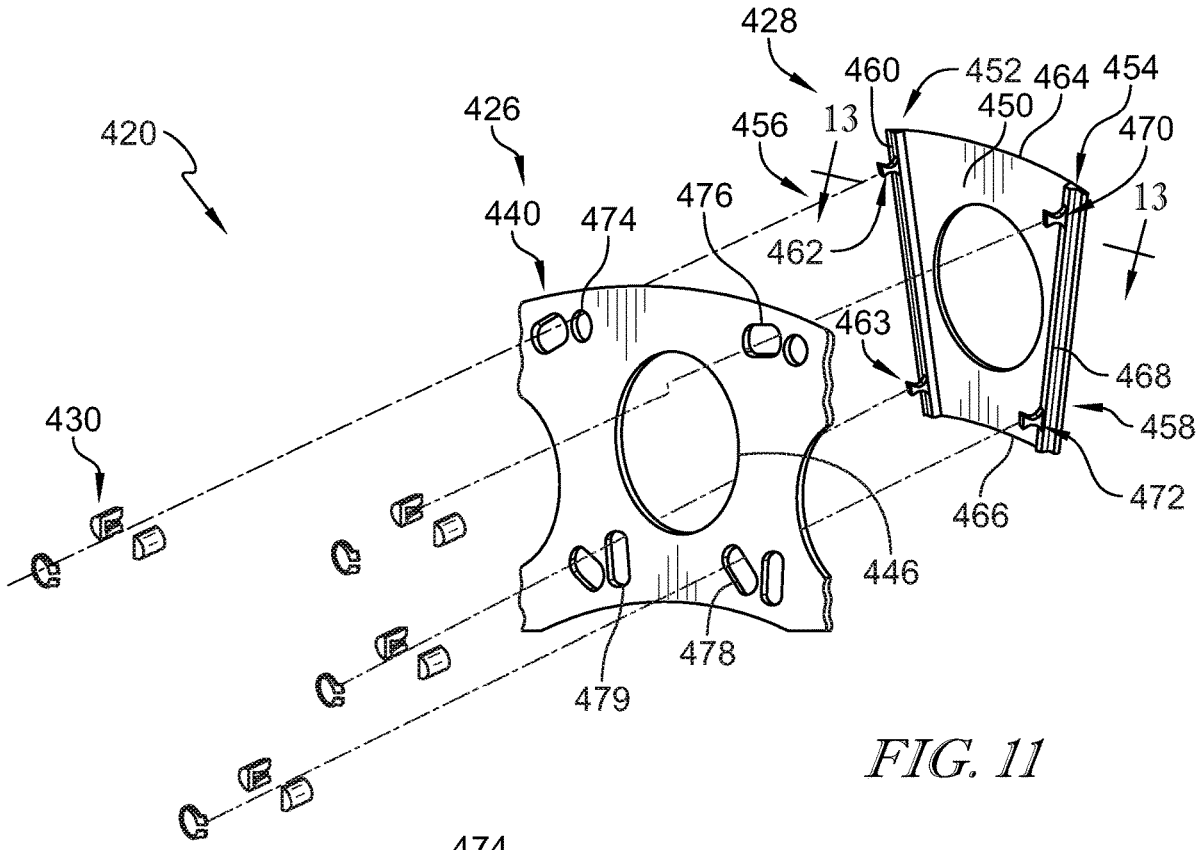
FIG. 11 is an exploded assembly view of a portion of another embodiment of a combustor showing including a combustor shell formed with a plurality of attachment apertures that correspond to a plurality of attachment posts coupled to a heat shield and showing that the attachment apertures are sized and shaped to allow movement of the combustor shell relative to the heat shield as a result of different rates of thermal expansion.
Figure 12:
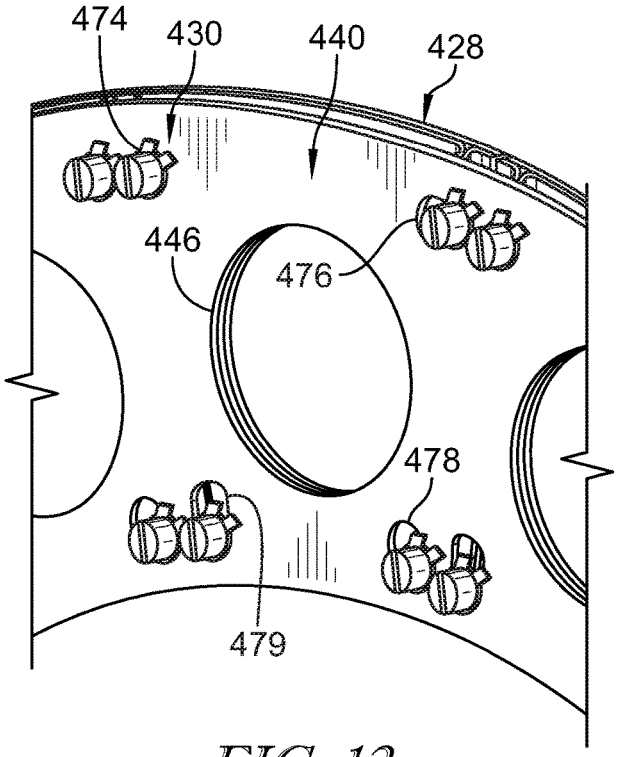
FIG. 12 is an assembled view of the portion of the combustor from FIG. 11 with each of the attachment posts drawn in phantom to indicate that they are received and retained by respective heat shield retainers to block removal of the heat shield away from the combustor shell.

The combustor 420 includes a combustor shell 426 made from metallic materials, a heat shield 428 made from ceramic matrix composite materials, and a plurality of heat shield retainers 430 as shown in FIGS. 11 and 12. The combustor shell 426 includes a dome panel 440. The heat shield 428 is formed into a one-piece CMC and includes a shield panel 450, a first mount flange 452, and a second mount flange 454. The shield panel 450 borders an inner surface of the dome panel 440 to protect a portion of the combustor shell from the burning gases in combustion chamber 434. The first mount flange 452 is arranged along a first circumferential side 456 of the shield panel 450. The second mount flange 454 is arranged along a second circumferential side 458 of the shield panel 450 opposite the first circumferential side 456.

Figure 13:
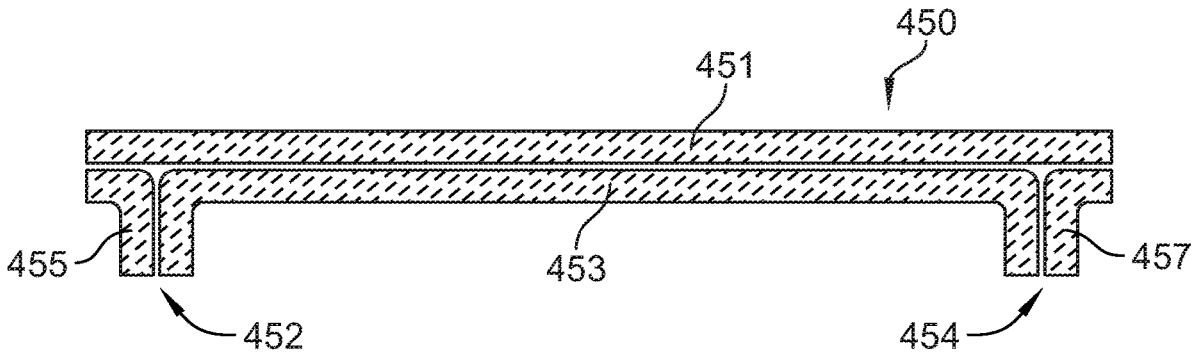
FIG. 13 is a cross section view of the heat shield taken along line 13-13 in FIG. 11 showing that the heat shield is formed from a ceramic matrix composite layup that provides the heat shield with a shield panel, a first mount flange arranged along a first circumferential side of the shield panel, and a second mount flange arranged along a second circumferential side of the shield panel.

The first and second mount flanges 452, 454 extend away from the shield panel 450 toward the dome panel 440 of the combustor shell 426 as shown in FIGS. 11 and 13. The heat shield 428 is formed from a ceramic ply layup comprising a back-plate ply 451, a front-plate ply 453, a first edge ply 455, and a second edge ply 457 as shown in FIG. 13. The back-plate ply 451 forms an axially aft surface of the shield panel 450 and extends between the first and second circumferential sides 456, 458. The front-plate ply 453 forms a portion of an axially forward surface of the shield panel 450 and a portion of the first and second mount flanges 452, 454. The first edge ply 455 forms a portion of the axially forward surface of the shield panel 450 and a portion of the first mount flange 452. The second-edge ply forms a portion of the axially forward surface of the shield panel 450 and a portion of the second mount flange 454.

The first mount flange 452 includes an offset lip 460, a first attachment post 462 coupled to the offset lip 460, and a second attachment post 463 coupled to the offset lip 460 as shown in FIG. 11. The first offset lip 460 extends along the first circumferential side 456 from a radially outer edge 464 of the shield panel 450 to a radially inner edge 466 of the shield panel 450. The first offset lip 460 is slightly spaced inward from an edge of the shield panel 450. The first attachment post 462 is located closer to the radially outer edge 464 than the radially inner edge 466. The second attachment post 462 is located closer to the radially inner edge 466 than the radially outer edge 468.

The second mount flange 454 includes an offset lip 468 and a pair of attachment posts 470, 472 coupled to the offset lip 468 as shown in FIG. 11. The offset lip 468 extends along the second circumferential side 458 from the radially outer edge 464 of the shield panel 450 to the radially inner edge 466 of the shield panel 450. The second offset lip 468 is slightly spaced inward from an edge of the shield panel 450. The first attachment post 470 is located closer to the radially outer edge 464 than the radially inner edge 466. The second attachment post 472 is located closer to the radially inner edge 466 than the radially outer edge 464. The first attachment post 462 of the first mount flange 452 is spaced circumferentially from the second mount flange 454 and located radially between the first and second attachment posts 470, 472 of the second mount flange 454.

Figure 14:
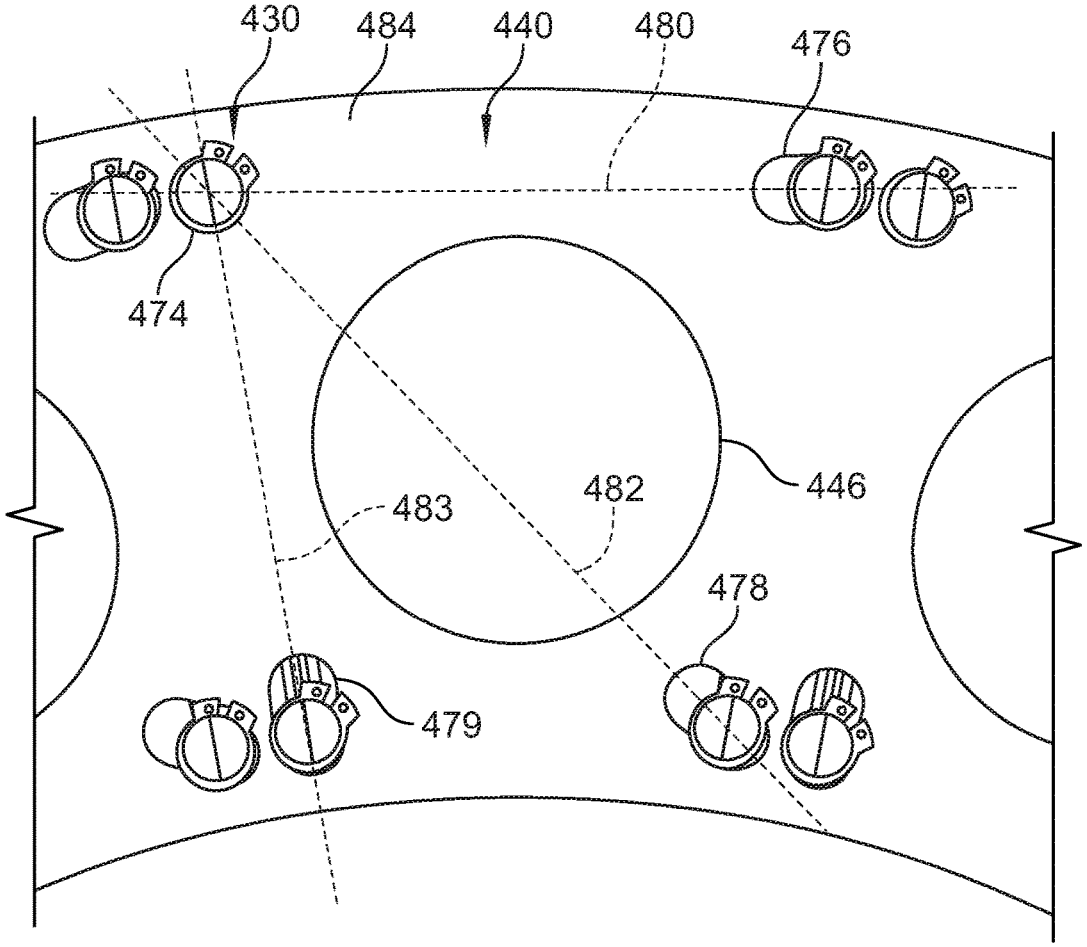
FIG. 14 is an aft-looking elevation view of the portion of the combustor shown in FIG. 12 with dashed lines indicating that three of the attachment apertures are elongated along respective axes that intersect at a fourth circular-shaped attachment aperture.

Each of the attachment posts 462, 463, 470, 472 extends axially through a corresponding attachment aperture 474, 476, 478, 479 formed in the dome panel 440 to mount the heat shield 428 to the dome panel 440 as shown in FIGS. 12 and 14. The attachment apertures 474, 476, 478, 479 are sized and shaped so that the dome panel 440 can move relative to the heat shield 428 due to different rates of thermal expansion between the dome panel 440 and the heat shield 428. This blocks binding stresses from forming in the heat shield 428 as a result of the different expansion rates which could damage the heat shield 428 and leave the combustor shell vulnerable to the hot gases.

The plurality of attachment apertures includes a first circular-shaped attachment aperture 474, a second elongated attachment aperture 476, a third elongated attachment aperture 478 and a fourth elongated attachment aperture 479. The first and fourth attachment apertures 474, 479 are generally aligned circumferentially and are spaced apart radially from one another. The first and fourth attachment apertures 474, 479 are located on an opposite circumferential side of fuel nozzle aperture 446 from the second and third attachment apertures 476, 478. The second and third attachment apertures 476, 478 are generally aligned circumferentially and are spaced apart radially from one another.

The attachment apertures 474, 476, 478, 479 cooperate to locate the heat shield 428 relative to the first attachment aperture 474 while allowing movement of the second, third, and fourth attachment apertures 476, 478, 479 relative to the heat shield 428 as the dome panel 440 expands and contracts. The first attachment post 462 is received in the first attachment aperture 474 and is generally fixed relative to the dome panel 440 as shown in FIG. 14. The second attachment post 463 of the first mount flange 452 is received in the fourth attachment aperture 479. The first attachment post 470 of the second mount flange 454 is received in the second attachment aperture 476 while the second attachment post 472 of the second mount flange 454 is received in the third attachment aperture 478.

The second attachment aperture 476 is elongated along a first axis 480. The third attachment aperture 478 is elongated along a second axis 482. The fourth attachment aperture 479 is elongated along a third axis 483. The first, second, and third axes 480, 482, 483 intersect at the first attachment aperture 474. The dome panel 440 moves relative to the second and third attachment posts 463, 470, 472 such that the attachment posts 463, 470, 472 slide along axes 480, 482, 483 through the attachment apertures 476, 478, 479 as the dome panel 440 expands and contracts.

Once the attachment posts 462, 463, 470, 472 are positioned in their respective attachment apertures 474, 476, 478, 479, a corresponding heat shield retainer 430 is configured to engage each attachment post 462, 463, 470, 472 along an outer surface 484 of the dome panel 440 as shown in FIGS. 12 and 14. The heat shield retainers 430 have a diameter that is larger than the attachment apertures 474, 476, 478, 479 to block the attachment posts 462, 463, 470, 472 from being removed from the attachment apertures 474, 476, 478, 479. The heat shield retainers 430 may be similar to any of the heat shield retainers described above.

The ceramic matrix composite materials in the illustrative embodiments described herein may comprise silicon carbide fibers suspended in a silicon carbide matrix (SiC—SiC CMC), however, any suitable ceramic matrix composite composition may be used. The heat shields are made from silicon carbide fiber preforms that are infiltrated with ceramic matrix material. The fiber preforms may be a two-dimensional ply preform or a three-dimensionally woven or braided preform. Prior to infiltration, the preforms may be molded into a desired shape, as shown in FIG. 6, or multiple preform plies may be laid-up to form the desired shape, as shown in FIG. 13. Once molded into the desired shape, the fiber preforms are infiltrated with ceramic matrix material through chemical vapor infiltration to solidify and/or densify the fibers. Where multiple plies are used to form a lay-up, the infiltration process also integrates all of the plies together to form a one-piece CMC. The fiber preforms may be also be processed through other suitable processes such as slurry infiltration, melt infiltration and/or polymer infiltration and pyrolysis. Once densified, the finished ceramic matrix composite component may be machined to finalize the desired shape.

In some embodiments, when compared to metallic combustor heat shields, the implementation of CMC heat shields in a combustion system may result in a decrease in cooling air requirements within the system. This could allow for either more air to be used to cool other components, or for air to be routed directly back to the core. This could allow for improved operation at higher temperatures, as well as for an increase in power output without an increase to the air intake. Additionally, the implementation of CMCs into the combustor system may result in weight reductions.

In some embodiments, one of the functions of a heat shield is shielding the combustor dome panel from the intense heat within the combustion chamber. Thus, the heat shield comes into direct contact with and often fixtures to the dome panel. Due to the high discrepancies between the coefficients of thermal expansion (CTEs) of the CMC and the metallic dome panel, management of thermal stresses and rates of thermal expansion may be required when considering how to attach the CMC heat shield to the dome panel.

In some embodiments, in order to minimize the stresses exerted on the CMC heat shield fixture, the locating features of the dome panel which relate its position to that of the heat shield may be designed such that the heat shield remains fixed in all directions, but allows for the dome panel to expand freely relative to the heat shield. The present disclosure discusses CMC heat shields in a combustion system and the construction of the heat shield and how it attaches to the dome panel.

In some embodiments, a single laminate or ply forms the entirety of the heat shield body, with the circumferential edges of the laminate creating two axially protruding flanges on the forward side of the laminate. Attachment features would be machined from these flanges. One edge flange includes a single attachment while the other includes two attachments. Clam-shell collars are mated around the attachment flanges and a retaining ring or clip is placed around both clam-shells to fix the assembly axially and block the collars from separating. A second retaining ring may be added to the clam-shells to block any separation caused by pinching from the first retaining ring.

In some embodiments, basic through holes on the dome panel are used to position the heatshield dowels; however, for CMC applications, this arrangement may cause stresses on the heat shield attachment geometry due to the dome panel expanding at a faster rate than the CMC. To counteract this, only one clam shell collar subassembly is positioned with a basic (circular) through hole on the dome panel, the remaining subassemblies are positioned within slotted hole cutouts on the dome panel. This arrangement fixes the heatshield both radially and circumferentially, and, since the retaining rings do not apply any clamping force on the dome panel and heat shield, the dome panel is allowed to expand freely along the direction of the slots as temperatures increase during operation.

In some embodiments, the CMC heat shield may include an extrusion on the forward side of the heat shield that is used to position and fix the heat shield relative to the dome panel. The CMC heat shield may be constructed from 4 sub-laminates or plys with one flat 'chamber-side' laminate defining the entire aft section of the heatshield, two L-shaped laminates, and a U-shaped laminate defining the forward section as shown in FIG. 13. The forward laminates form two flanges where attachment geometry would be machined out of the flange body. These machined features are used to mate two symmetrical 'clam-shell' collars to the heat shield on either side of each flange. Once the collars are positioned on the machined features, the heatshield is positioned with respect to the dome panel and retaining rings or clips are added around the collar subassemblies, which restricts the axial movement of the heat shield relative to the dome panel and also prevents the collars from separating. A second retaining ring could also be added to the clam-shells to prevent any separation caused by pinching from the first retaining ring.

In some embodiments, the geometry associated with the machined attachment features may vary between a dovetail, bulb, and fir tree shape. The inner machined face of the clam-shell collars would also vary, respective to the geometry found on the heat shield flanges. The attachment subassembly comprising of the heatshield flanges, the clam-shell collars, and the retaining rings block axial movement of the heat shield caused by pressure differences between either sides of the dome panel/heat shield assembly.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor for use in a gas turbine engine, the combustor comprising a combustor shell comprising metallic materials adapted to be mounted in the gas turbine engine and formed to define an internal cavity, the combustor shell including an outer annular wall that extends circumferentially around a central reference axis, an inner annular wall arranged radially inward from the outer annular wall to provide the internal cavity between the outer annular wall and the inner annular wall, and a dome panel that extends from an axially-forward end of the outer annular wall to the inner annular wall to form a forward wall, the dome panel shaped to include fuel nozzle apertures spaced circumferentially around the central reference axis that open into the internal cavity, a heat shield comprising ceramic matrix composite materials, the heat shield coupled to the dome panel and arranged within the internal cavity to shield the dome panel from temperatures developed by burning fuel within a combustion chamber inside the internal cavity during use of the combustor in the gas turbine engine, the heat shield including a shield panel, a first mount flange arranged along a first circumferential side of the shield panel, and a second mount flange arranged along a second circumferential side of the shield panel, and a plurality of heat shield retainers configured to retain the heat shield to the dome panel, wherein the first and second mount flanges each include at least one attachment post that extends axially through an attachment aperture formed in the dome panel to engage a corresponding heat shield retainer arranged on an axially-forward side of the dome panel, the attachment aperture being sized and shaped so that the dome panel moves relative to the heat shield due to different rates of thermal expansion without forming stresses in the heat shield as a result of binding between the heat shield and the combustor shell, and wherein the first mount flange includes an offset lip that extends along the first circumferential side from a radially outer edge of the shield panel to a radially inner edge of the shield panel and a first attachment post located about midway between the radially outer edge and the radially inner edge.

2. The combustor of claim 1, wherein the second mount flange includes an offset lip that extends along the second circumferential side from the radially outer edge of the shield panel to the radially inner edge of the shield panel and a second attachment post located closer to the radially outer edge than the radially inner edge and a third attachment post located closer to the radially inner edge than the radially outer edge.

3. The combustor of claim 2, wherein the heat shield is bent at each circumferential side to provide the first mount flange and the second mount flange.

4. The combustor of claim 2, wherein the first attachment post of the first mount flange is positioned radially between attachment posts of a first circumferentially neighboring heat shield.

5. The combustor of claim 4, wherein the second attachment post of the second mount flange is positioned radially outward of an attachment post of a second circumferentially neighboring heat shield and the second third attachment post of the second mount flange is positioned radially inward of the attachment post of the second circumferentially neighboring heat shield.

6. The combustor of claim 2, wherein the dome panel of the combustor shell is formed to include a plurality of attachment apertures comprising a first circular-shaped attachment aperture, a second elongated attachment aperture spaced apart circumferentially from the first attachment aperture, and a third elongated attachment aperture spaced apart circumferentially from the first attachment aperture and radially from the second attachment aperture.

7. The combustor of claim 6, wherein the second attachment aperture is elongated along a first axis and the third attachment aperture is elongated along a second axis and the first and second axes intersect at the first attachment aperture.

8. The combustor of claim 7, wherein the plurality of attachment apertures further comprises a fourth elongated attachment aperture spaced apart radially from the first attachment aperture and circumferentially from the second and third attachment apertures and the fourth attachment aperture is elongated along a third axis that intersects with the first and second axes at the first attachment aperture.

9. The combustor of claim 1, wherein each heat shield retainer includes a first half and a second half arranged to combine with the first half and enclose a respective attachment post of the at least one attachment post to block the respective attachment post from being removed from the attachment aperture.

10. The combustor of claim 9, wherein the respective attachment post has a shape and the first half and the second half are formed to include a groove that matches the shape of the respective attachment post, each groove having a depth that is about half of a thickness of the attachment post.

11. The combustor of claim 9, wherein the first half and the second half are retained together by a spring clip to block the attachment post from being removed from the attachment aperture.

12. The combustor of claim 1, wherein the second mount flange includes an offset lip that extends from a radially outer edge of the shield panel to a radially inner edge of the shield panel, a second attachment post located closer to the radially outer edge than the radially inner edge, and a third attachment post located closer to the radially inner edge than the radially outer edge.

13. The combustor of claim 1, wherein the heat shield is formed from a ceramic ply layup comprising a back-plate ply forming an axially aft surface of the shield panel, a front-plate ply forming a portion of an axially forward surface of the shield panel and a portion of the first and second mount flanges, a first edge ply forming a portion of the axially forward surface of the shield panel and a portion of the first mount flange, and a second edge ply forming a portion of the axially forward surface of the shield panel and a portion of the second mount flange.

14. A method of retaining a heat shield to a combustor in a gas turbine engine, the method comprising providing the combustor with a combustor shell comprising metallic materials and formed to define an internal cavity, the combustor shell including an outer annular wall that extends circumferentially around a central reference axis, an inner annular wall arranged radially inward from the outer annular wall to provide the internal cavity between the outer annular wall and the inner annular wall, and a dome panel that extends from an axially-forward end of the outer annular wall to the inner annular wall to form a forward wall, the dome panel shaped to include fuel nozzle apertures spaced circumferentially around the central reference axis that open into the internal cavity, forming the heat shield from ceramic matrix composite components, the heat shield including a shield panel lining the dome panel of the combustor shell and providing a boundary for an interior combustion chamber, a first mount flange arranged along a first circumferential side of the shield panel, and a second mount flange arranged along a second circumferential side of the shield panel, the first and second mount flange each including at least one attachment post that extends away from the shield panel, forming a plurality of attachment apertures in the dome panel of the combustor shell, inserting the attachment posts through respective attachment apertures, and retaining each attachment post to the dome panel with a heat shield retainer to block removal of the attachment posts from the attachment apertures, wherein the attachment apertures are sized and shaped so that the dome panel is allowed to move relative to the heat shield due to different rates of thermal expansion without forming stresses in the heat shield as a result of binding between the heat shield and the dome panel, and wherein the first mount flange includes an offset lip that extends along the first circumferential side from a radially outer edge of the shield panel to a radially inner edge of the shield panel and a first attachment post located about midway between the radially outer edge and the radially inner edge.

15. The method of claim 14, wherein each heat shield retainer includes a first half, a second half arranged to combine with the first half and enclose a respective attachment post to block the attachment post from being removed from the attachment aperture, and a spring clip configured to retain the first half to the second half enclosing the attachment post.

16. The method of claim 14, wherein the step of forming the heat shield includes forming the heat shield from at least one ceramic ply that is bent at each circumferential edge to provide the first mount flange and the second mount flange once infiltrated with ceramic matrix material so that the first mount flange and the second mount flange are made integral with the shield panel.

17. The method of claim 14, wherein the step of forming the heat shield includes forming the heat shield from a ceramic ply layup comprising a back-plate ply forming an axially aft surface of the shield panel, a front-plate ply forming a portion of an axially forward surface of the shield panel and a portion of the first and second mount flanges, a first edge ply forming a portion of the axially forward surface of the shield panel and a portion of the first mount flange, and a second edge ply forming a portion of the axially forward surface of the shield panel and a portion of the second mount flange.

18. A combustor for use in a gas turbine engine, the combustor comprising a combustor shell comprising metallic materials adapted to be mounted in the gas turbine engine and formed to define an internal cavity, the combustor shell including a dome panel shaped to include fuel nozzle apertures spaced circumferentially around a central reference axis that open into the internal cavity, a heat shield comprising ceramic matrix composite materials, the heat shield coupled to the dome panel and arranged within the internal cavity, the heat shield including a shield panel, a first mount flange arranged along a first circumferential side of the shield panel, and a second mount flange arranged along a second circumferential side of the shield panel, and a plurality of heat shield retainers configured to retain the heat shield to the dome panel, wherein the first mount flange includes an integral first attachment post and the second mount flange includes an integral second attachment post, the first and second attachment posts extend axially through respective first and second attachment apertures formed in the dome panel to engage a corresponding heat shield retainer included in the plurality of heat shield retainers arranged on an axially-forward side of the dome panel, and wherein each heat shield retainer includes a first half and a second half arranged to combine with the first half and enclose one of the first and second attachment posts, each heat shield retainer having a diameter that is larger than the first and second attachment apertures to block each heat shield retainer from passing through the first and second attachment apertures and the first and second attachment posts from being removed from the first and second attachment apertures when the heat shield retainers are installed on the first and second attachment posts, wherein the first mount flange further includes an offset lip that extends along the first circumferential side from a radially outer edge of the shield panel to a radially inner edge of the shield panel, and the first attachment post is located about midway between the radially outer edge and the radially inner edge.

19. The combustor of claim 18, wherein the first and second attachment posts have a first, flat circumferential side and a second, flat circumferential side opposite the first, flat circumferential side, and wherein the first and second attachment posts each have one of a dovetail shape, a firtree shape, and a bulb shape defined by the first, flat circumferential side and the second, flat circumferential side such that the first and second attachment posts have a constant thickness in the circumferential direction and a varying thickness in a radial direction.

* * * * *